United States Patent [19]

Ono et al.

[11] 4,104,981

[45] Aug. 8, 1978

[54] INDICATOR USING CHANGEABLE PATH THROUGH TRANSPARENT MATERIAL

[75] Inventors: Katsutoshi Ono, Ichikawa; Koichi Sekiguchi, Shakujii, both of Japan

[73] Assignee: Nissan Motor Company, Ltd., Japan

[21] Appl. No.: 718,970

[22] Filed: Aug. 30, 1976

[30] Foreign Application Priority Data

Sep. 10, 1975 [JP] Japan ..... 50/124438[U]

[51] Int. Cl.[2] ..... H01H 9/16

[52] U.S. Cl. ..... 116/124 L; 116/DIG. 28; 116/124.4; 200/313; 200/314; 200/315; 200/316

[58] Field of Search ..... 116/124 L, DIG. 28, 116/124.4, 136; 200/313, 314, 315, 316

[56] References Cited

U.S. PATENT DOCUMENTS

| | | | |
|---|---|---|---|
| 1,823,319 | 9/1931 | Dickinson | 200/314 |
| 1,990,639 | 2/1935 | Dewhurst | 116/124.4 |
| 2,109,790 | 3/1938 | Batcheller | 116/124 L |
| 2,285,374 | 6/1942 | Dohsmann | 200/314 |
| 3,144,643 | 8/1964 | Andersson | 116/DIG. 28 |
| 3,518,386 | 6/1970 | Guberman | 200/313 |
| 3,632,938 | 1/1972 | Stessel | 116/135 |
| 3,645,227 | 2/1972 | Lahmer | 116/128 |
| 4,023,003 | 5/1977 | Arthur et al. | 116/124 L |

*Primary Examiner*—S. Clement Swisher
*Assistant Examiner*—Denis E. Corr
*Attorney, Agent, or Firm*—Robert E. Burns; Emmanuel J. Lobato; Bruce L. Adams

[57] ABSTRACT

An indicator comprises first means adapted for emitting a ray of light; and second means having an indicating surface for receiving the ray of light to permit the ray of light to illuminate the indicating surface. The first and second means are movable relative to each other to vary intensity of illumination of the indicating surface.

5 Claims, 11 Drawing Figures

Fig. 3A
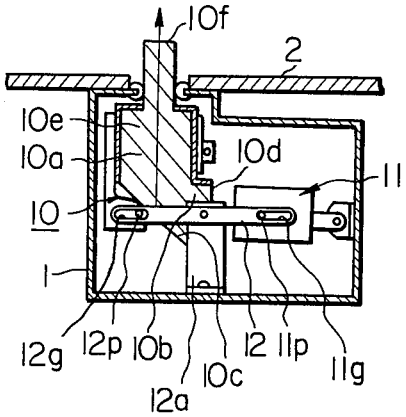
Fig. 3B
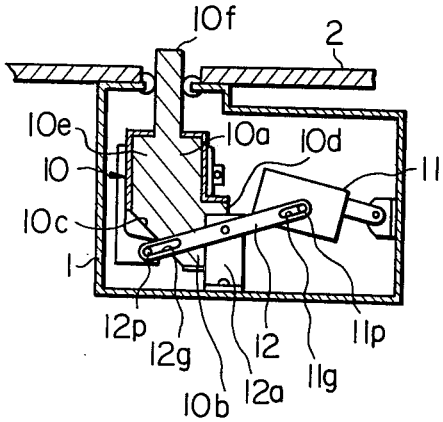
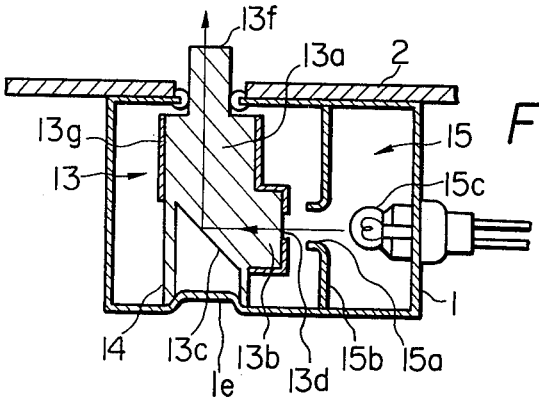
Fig. 4A
Fig. 4B
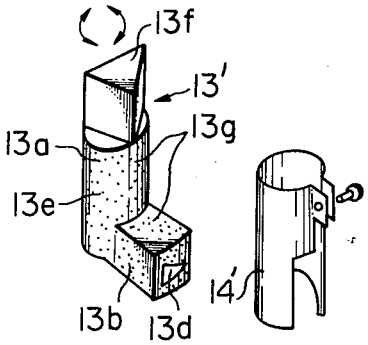

INDICATOR USING CHANGEABLE PATH THROUGH TRANSPARENT MATERIAL

BACKGROUND OF THE INVENTION

The present invention relates to an indicator and more particularly to an indicator having an indicating surface in which intensity of illumination of the indicating surface is variable.

Recently there is an increasing tendency in the use of a number of indicators which are exposed to view of a driver of an automobile. The conventional indicators have an indicating surface and a lamp adapted to illuminate the indicating surface. The lamp is electrically connected with a monitor, such as a monitor to respond to a failure of a brake or a monitor responsive to a drop in engine oil pressure. In order to reduce the risk that the illumination of the great number of indicators might distract the driver from viewing forward thereby increasing the possibility that the automobile may be involved in an accident, it is conventional practice to provide the lamp with a switch of the ON-OFF type in order to turn the indicator on when inspection is necessary and turn it off when inspection is not necessary. However the use of the switch of the ON-OFF type has a disadvantage that its electrical contacts are less durable and require a special measure to prevent mulfunction of the switch.

SUMMARY OF THE INVENTION

According to the present invention, an indicator comprises first means adapted for emitting a ray of light; and second means having an indicating surface for receiving the ray of light to permit the ray of light to illuminate said indicating surface, said first and second means being movable relative to each other to vary the intensity of illumination of said indicating surface.

BRIEF DESCRIPTION OF THE DRAWINGS

The present invention will be more precisely described in the following taken in conjunction with the accompanying drawings, in which:

FIG. 3B is a schematic sectional view of a third embodiment of an indicator according to the present invention, the parts of the indicator being in "ON" position;

FIG. 3B is a similar view showing the indicator shown in FIG. 3A in which the parts are in "OFF" position;

FIG. 4A is a schematic sectional view of a fourth embodiment of an indicator according to the present invention;

FIG. 4B is a disassembled view of a modified part which may replace the corresponding part used in the indicator shown in FIG. 4A;

DESCRIPTION OF THE PREFERRED EMBODIMENTS

Figure 1A:
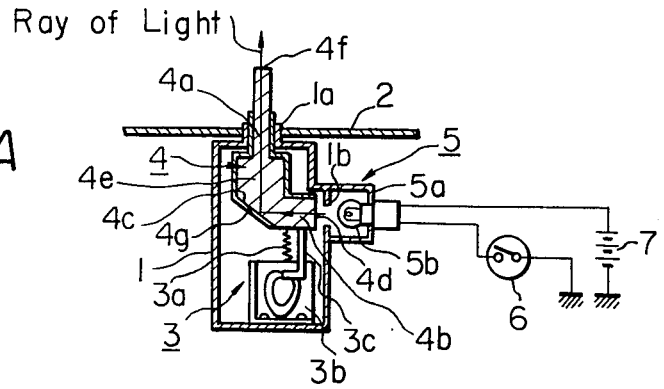
FIG. 1A is a schematic sectional view of a first embodiment of an indicator according to the present invention, the indicator being electrically connected with a monitor, the parts of the indicator being in "ON" position.
Figure 1B:
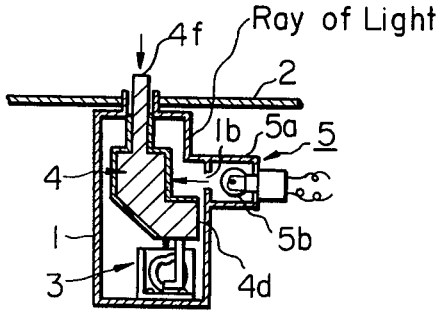
FIG. 1B is a similar view showing the indicator shown in FIG. 1A in which the parts are in "OFF" position.

Referring to FIGS. 1A and 1B, a casing 1 of an indicator is attached to an indicating panel 2 with its tubular section 1*a* disposed within an opening formed through the indicating panel 2. A switch mechanism 3 of the so-called "push-push" type, which is known per se, is mounted within the casing 1 and includes a spring 3*a* and, a member 3*b* formed with an asynmetrical cam groove.

Reference numeral 4 indicates a member to receive a ray of light emitted by a light emitting unit 5. The member 4 is fixed to the claw member 3*c* that slidably engages the cam groove so that it is movable between the position illustrated in FIG. 1A and the position illustrated in FIG. 1B by manually pushing the member 4 downwardly as viewed in FIGS. 1A and 1B. The member 4 comprises a body 4*a* made of a transparent material. The body 4*a* has a light-in portion 4*b* projecting from a reflecting surface 4*c* and terminating in at a light receiving surface 4*d* and a light-out portion 4*e* projecting from the reflecting surface 4*c* and terminating in at an indicating surface 4*f* so that light that passes through the light receiving surface 4*d* travels through the light-in portion 4*b* to strike the reflecting surface 4*c* and after bouncing off it travels the light-out portion 4*e* to reach the indicating surface 4*f* to illuminate the same. When the member 4 is in the position illustrated in FIG. 1A, the light receiving surface 4*d* is in the path of the ray of light from the light emitting unit 5. When the member 4 is in the position illustrated in FIG. 1B, the light receiving surface 4*d* is out of the path of the ray of light. The body 4*a* is coated with a reflecting material on the exterior surface of the body 4*a*. Of coure the indicating surface 4*f* and light receiving surface 4*d* are not coated with the reflecting material. The reflecting material, indicated by 4*g* includes a mirror, an aluminum foil, a silver paper. Preferably, the reflecting material has a rough surface on that side which contacts with the exterior surface of the body 4*a* to provide a rough reflection.

It is possible to coat the exterior surface of the body 4*a* with a fluorescent paint. Of course the indicating surface 4*f* and light receiving surface 4*d* are not coated with the fluorescent paint and the exterior surface of an inclined portion is coated with the reflecting material to provide the reflecting surface 4*c*.

The light-in portion 4*b* may take the form of a cylinder with its exterior surface coated with the reflecting material.

As shown in FIG. 1A, the casing 1 is formed with an aperture 1*b* at a location opposite to the light receiving surface 4*d* when the member 4 is in the position illustrated in FIG. 1A. The light emitting unit 5 comprises a box 5*a* closed by that wall of the casing 1 which is formed with the aperture 1*b* and a lamp 5*b* disposed in the box 5*a*.

The lamp 5*b* is electrically connected with a monitor having a temperature sensing switch 6 and a source of electricity 7. The lamp 5*b* is turned on when the temperature sensing switch 6 is closed and off when the temperature sensing switch 6 is opened. Only when the lamp 5*b* is turned on, the unit 5 emits the ray of light through the aperture 1*b*. The temperature sensing switch 6 is closed when the engine temperature is abnormally high.

When a driver inspects the engine temperature, he pushes the member 4 to cause it to take the position illustrated in FIG. 1A. Then he can recognize that the engine temperature is abnormally high when there is the illumination of the indicating surface 4*f*. When he does not want to inspect the engine temperature, he pushes the member 4 again to cause it to take the position illustrated in FIG. 1B.

Figure 2A:
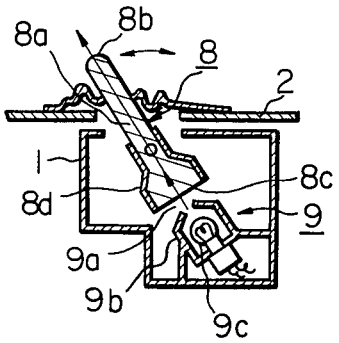
FIG. 2A is a schematic sectional view of a second embodiment of an indicator according to the present invention, the parts of the indicator being in "ON" position.
Figure 2B:
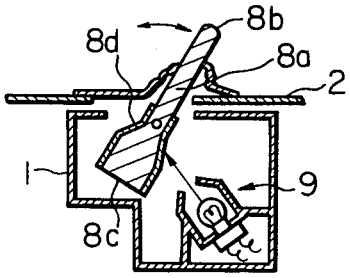
FIG. 2B is a similar view showing the indicator shown in FIG. 2A in which the parts are in "OFF" position.

The second embodiment shown in FIGS. 2A and 2B comprises a member 8 to receive a ray of light emitted by a light emitting unit 9. The member 8 comprises a body 8*a* made of a transparent material. The body 8*a* is generally in the form of a rod and comprises an indicating surface 8*b* at one end thereof and a light receiving surface 8*c* at an opposite end thereof so that light that passes through the light receiving surface 8*c* travels through the body 8*a* to reach the indicating surface 8*b* to illuminate the same. The body 8*a* is pivoted to a casing 1 for rotation between the position illustrated in FIG. 2A and the position illustrated in FIG. 2A, the light receiving surface 8*c* is in the path of the ray of light. When the member 8 is in the position illustrated in FIG. 2B, the light receiving surface 8*c* is out of the path of the ray of light. The body 8*a* is coated with a reflecting material 8*d* or fluorescent paint at the exterior surface thereof. The light receiving surface 8*c* and indicating surface 8*b* are not coated with the reflecting material nor the fluorescent paint.

The light emitting unit 9 comprises a box 9*b* formed with an aperture 9*a* and a lamp 9*c* disposed within the box 9*b*.

In the position illustrated in FIG. 2A, the ray of light (see arrow A) passes through the light receiving surface 8*c*, travels through the body 8*a* and reaches the indicating surface 8*b* to illuminate the same. In the position illustrated in FIG. 2B, the light receiving surface 8*c* is out of the path of the ray of light and the ray of light strikes the coating material 8*c* which shields the ray of light and prevents it from entering the body 8*a* so that the ray of light will not illuminate the indicating surface 8*b*.

The third embodiment shown in FIGS. 3A and 3B comprises a member 10 to receive a ray of light emitted by a light emitting unit 11. The light emitting unit 11 is pivoted to a casing 1 for rotation. The member 10 comprises a body 10*a* made of a transparent material. The body 10*a* has a light-in portion 10*b* projecting from a reflecting surface 10*c* and terminating in at a light receiving surface 10*d* and a light-out portion 10*e* projecting from the reflecting surface 10*c* and terminating in at an indicating surface 10*f* so that light that passes through the light receiving surface travels through the light-in portion 10*b* to strike the reflecting surface and after bouncing off it travels through the light-out portion 10*e* to reach the indicating surface 10*f* to illuminate the same. A lever 12 has an arm formed with a groove 12*g* in which a pin 12*p* fixed to the body 10*a* is received and an opposite arm formed with a groove 11*g* in which a pin 11*p* fixed to the light emitting unit 11 is received. The lever 12 has its intermediate portion pivoted to a bracket 12*a* fixed to the casing 1 for rotation so that reciprocal movement of member 10 causes rotational movement of the light emitting unit 11.

In the position of parts illustrated in FIG. 3A, the light receiving surface 10*a* is in the path of the ray of light so that the ray of light reaches the indicating surface to illuminate the same. In the position of parts illustrated in FIG. 3B, the light receiving surface 10*a* is out of the path of the ray of light and the ray of light strikes a reflecting material 10*c* on the exterior surface of the body 10*a*. Then the reflecting material 10*c* prevents the ray of light from entering the body 10*a* so that the ray of light will not reach the indicating surface 10*f*.

It is to be noted that in the embodiments shown in FIGS. 1A and 1B and in FIGS. 2A and 2B, the light emitting unit is fixed relative to the casing, while the member to receive a ray of light emitted by the light emitting unit is reciprocally movable with respect to the casing. On the other hand in the embodiment shown in FIGS. 3A and 3B both the member to receive a ray of light and the light emitting unit to emit the ray of light are movable in cooperation with each other.

It is also to be noted that the indicators shown and described in the preceding permit the illumination of the indicating surface to be turned on and off without the use of electrical contacts.

The embodiment shown in FIG. 4A is provided with different feature from the preceding embodiments that intensity of illumination of the indicating surface is continuously variable.

Referring to FIG. 4A a casing 1 is formed at its bottom wall with a circular elevated portion 1*e*. A member 13 to receive a ray of light emitted by a light emitting unit 15. The member 13 comprises a body 13*a* made of a transparent material and formed with a sleeve-like portion 14 coupling with the circular elevated portion 1*e* for rotation with respect to the casing 1. The body 13*a* has a light-in portion 13*b* projecting from a reflecting surface 13*c* and terminating in at an end having a light receiving surface 13*d* and a light-out portion 13*e* and terminating in at an indicating surface 13*f* so that light that passes through the light receiving surface 13*d* travels through the light-in portion 13*b* to strike the reflecting surface 13*c* and after bouncing off it travels through the light-out portion 13*e* to reach and illuminate the indicating surface 13*f*. The light receiving surface has shape which progressively reduces its area exposed to the ray of light as the body 13*a* rotates in one direction and progressively increases its area exposed to the ray of light as the body rotates in the opposite direction. In this embodiment the shape of the light receiving surface 13*d* is generally of a wedge. The body 13*a* is coated at its exterior surface with a reflecting material 13*g*. The light receiving surface 13*d* and indicating surface 13*f* are not coated with such material.

The member 13 is rotatable between a position at which the area of the light receiving surface 13*d* which is exposed to the ray of light is the maximum and a position at which the area of the light receiving surface 13*d* which is exposed to the ray of light is the minimum. Thus rotating the member 13 from the first mentioned position toward the second mentioned position will reduce amount of light entering the body 13*a* and reaching to illuminate the indicating surface 13*f*, while rotating the member 13 from the second position toward the first position increase amount of light entering the body 13*a* and reaching to illuminate the indicating surface 13*f*. Thus the intensity of illumination of the indicating surface 13*f* gradually varies as the member 13 rotates.

The light emitting unit 15 has a box one wall of which is a partition 15*b* formed with an aperture 15 located opposite to the light receiving surface 13*d* and a lamp 15*c* disposed within the box.

FIG. 4B shows a modification of the member 13 shown in FIG. 4A. A member 13' is different from the member 13 in that the member 13' comprises a body 13*a* of a transparent material and a collar formed with a sleeve-like portion 14', while the member 13 comprises the body 13*a* formed with the sleeve-like portion 14. The collar formed with the sleeve-like portion 14' is adapted to surround a light-out portion 13*e* of the body 13 of the member 13' (see FIG. 4B).

Figure 5:
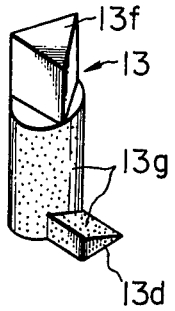
FIG. 5 is a modified part which may replace the corresponding part used in the indicator shown in FIG. 4A.

Referring to FIG. 5, a member 13" to receive a ray of light is different from the member 13 of FIG. 4A only in that cross section of a light-in portion of the member 13" is the same as the shape of a light receiving surface 13*d*. Thus the end of the light-in portion 13*b* agrees, in shape, with the light receiving surface 13*d* as shown in FIG. 5.

Figure 6A:
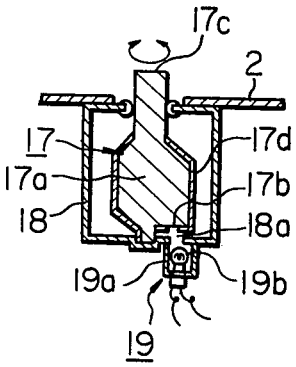
FIG. 6A is a schematic sectional view of a fifth embodiment of an indicator according to the present invention.
Figure 6B:
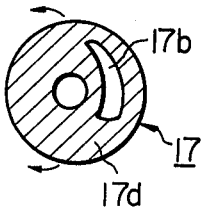
FIG. 6B is a bottom view of a part of the indicator shown in FIG. 6A.

The embodiment shown in FIGS. 6A and 6B comprises a member 17 to receive a ray of light emitted by a light emitting unit 19. The member 17 is rotatably mounted within a casing 18 attached to an indicating panel 2. The member 17 has a body 17*a* made of a transpatent material. The body 17*a* is generally of a rod and has a light receiving surface 17*b* at one end and an indicating surface 17*c*. The light receiving surface 17*b* has a shape which progressively reduces its area exposed to the ray of light as the body rotates in one direction and increases its area exposed to the ray of light.

The member 17 is coated at the exterior surface thereof a reflecting material 17*d*. The light receiving surface 17*b* and indicating surface 17*c* are not coated with such reflecting material.

The member 17 is rotatable between a first position at which the area of the light receiving surface 17*b* which is exposed to the ray of light is the maximum and a second position at which the area of the light receiving surface 17*b* which is exposed to the ray of light is the minimum. Thus rotating the member 17 from the first position toward the second position will reduce amount of light entering the body 17*a*, while rotating the member 17 from the second position to the first position will increase amount of light entering the body 17*a*. Thus the intensity of illumination of the indicating surface 17*c* gradually varies as the member 17 rotates.

The light emitting unit 19 has a box 19*a* formed with an aperture 18*a* disposed opposite to the light receiving surface 17*b* and a lamp 19*b* disposed in the box 19*a*.

Although in all of the preceding embodiments, the member to receive a ray of light is made of a transparent body, the light receiving member may take any other construction and arrangement as long as light entering the member reaches it indicating surface to illuminate the same.

It will now be observed that an indicator according to the present invention has a simple, compact, and low cost construction and high reliability.

Since the light receiving member may be made of any one of a wide variaty of materials differing in quality color and shape, it is easy to clearly differ one from another only by changing the material of the light receiving member and thus it is possible to set a particular indicator off the others. Moreover since the member formed with an indicating surface serves as a manipulator of an indicator, it is easy to find location of the particular indicator even at night.

What is claimed is:

1. An indicator comprising: first means for emitting a ray of light; and second means having an indicating surface for receiving the ray of light to permit the ray of light to illuminate said indicating surface, said first and second means being movable relative to each other to change their relative position to vary intensity of illumination of said indicating surface, said first and second means being movable relative to each other between a first position in which the ray of light illuminates said indicating surface and a second position in which the ray of light is prevented from illuminating said indicating surface, means mounting said first means for rotation, said second means including a body made of a transparent material, said body having a reflecting surface, a light-in portion projecting from said reflecting surface and terminating in at a light-receiving surface and a light-out portion projecting from said reflecting surface and terminating in at said indicating surface so that light that passes through said light-receiving surface travels through said light-in portion to strike said reflecting surface and after being reflected it travels through said light-out portion to reach and illuminate said indicating surface, means mounting said body reciprocally movable, and having an arm operatively connected with said body and an opposite arm operatively connected with said first means, and means mounting said lever for rotation so that the reciprocal movement of said body causes rotational movement of said first means.

2. An indicator comprising: first means for emitting a ray of light; and second means having an indicating surface for receiving the ray of light to permit the ray of light to illuminate said indicating surface, said first and second means being movable relative to each other to change their relative position to vary intensity of illumination of said indicating surface, means mounting said second means rotatably movable relative to said first means between a first position in which quantity of the ray of light reaching and illuminating said indicating surface is the maximum and a second position in which quantity of the ray of light reaching and illuminating said indicating surface is the minimum, said second means including a body made of a transparent material, said body having a reflecting surface, a light-in portion projecting from a reflecting surface and terminating in at an end having a light-receiving surface and a light-out portion projecting from said reflecting surface and terminating in at said indicating surface so that light that passes through said light-receiving surface travels through said light-in portion to strike said reflecting surface and after reflecting off it travels through said light-out portion to reach and illuminate said indicating surface, and said light-receiving surface having a shape which gradually reduces in area exposed to the ray of light as the body rotates from the first position toward the second position.

3. An indicator as claimed in claim 2, in which said end of said light-in portion is coated with a layer to define said shape.

4. An indicator as claimed in claim 2, in which said end of said light-in portion agrees, in shape, with said light receiving surface.

5. An indicator comprising: first means for emitting a ray of light; and second means having an indicating surface for receiving the ray of light to permit the ray of light to illuminate said indicating surface, said first and second means being movable relative to each other to change their relative position to vary intensity of illumination of said indicating surface, means mounting second means rotatably movable relative to said first means between a first position in which quantity of the ray of light reaching and illuminating said indicating surface is the maximum and a second position in which quantity of the ray of light reaching and illuminating said indicating surface is the minimum, said second means including a body made of a transparent material, said body having said indicating surface at one end thereof and an opposite end having a light-receiving surface, and said light-receiving surface having a shape which gradually reduces in area exposed to the ray of light as the body rotates from the first position toward the second position.

* * * * *